United States Patent [19]

Sainen et al.

[11] Patent Number: 4,619,294

[45] Date of Patent: Oct. 28, 1986

[54] METHOD OF AND APPARATUS FOR CONTROLLING MOTOR-DRIVEN LET-OFF AND TAKE-UP SYSTEM FOR LOOMS

[75] Inventors: Tsutomu Sainen; Takeshi Asai, both of Kanazawa, Japan

[73] Assignee: Tsudakoma Corp., Kanazawa, Japan

[21] Appl. No.: 692,273

[22] Filed: Jan. 17, 1985

[30] Foreign Application Priority Data

Jan. 20, 1984 [JP] Japan ..... 59-008956

[51] Int. Cl.[4] ..... D03D 49/06

[52] U.S. Cl. ..... 139/99; 139/109; 139/311

[58] Field of Search ..... 139/97, 99, 103, 109, 139/110, 105, 1 E, 309, 311

[56] References Cited

U.S. PATENT DOCUMENTS

| | | | |
|---|---|---|---|
| 3,802,467 | 4/1974 | Steverlynck | 139/108 |
| 3,878,872 | 4/1975 | Hintsch | 139/99 |
| 3,930,523 | 1/1976 | Garcia | 139/110 |
| 4,031,923 | 6/1977 | Van Duynhoven | 139/110 |
| 4,407,331 | 10/1983 | Rehling et al. | 139/110 |
| 4,513,790 | 4/1985 | Sainen et al. | 139/110 |
| 4,529,012 | 7/1985 | Sainen et al. | 139/110 |

*Primary Examiner*—Henry S. Jaudon
*Assistant Examiner*—Joseph S. Machuga
*Attorney, Agent, or Firm*—Flynn, Thiel, Boutell & Tanis

[57] ABSTRACT

Motor-driven let-off and take-up motions in a loom are controlled by controlling the rotation of a motor for driving warp yarns with a tension control system operating in response to a signal indicative of a target tension and a feedback input signal indicative of an actual tension of the object during a normal operation of the loom, and controlling the rotation of the motor with a feedforward control system during a transient operation of the loom, the feedforward control system storing operation patterns of directions, and speeds of rotation and angular displacement of the motor for respective operation modes and weaving conditions of the loom. At the time of the transient operation, and operating condition of the loom is detected, an appropriate operation pattern is read from the feedforward control system based on the detected operation mode, and the read operation pattern is applied as a control signal to a drive control system for the motor.

5 Claims, 6 Drawing Figures

METHOD OF AND APPARATUS FOR CONTROLLING MOTOR-DRIVEN LET-OFF AND TAKE-UP SYSTEM FOR LOOMS

BACKGROUND OF THE INVENTION

1. Field of the Invention

The present invention relates to motor-driven let-off and take-up technology for looms, and more particularly to a method of and an apparatus for feedforward control effective for transient operation at the time of starting a loom.

2. Description of the Prior Art

Let-off motions for looms serve to feed a warp yarn from a supply beam under suitable tension, and take-up motions serve to progressively wind a woven fabric under given tension. These motions are controlled by a control system which is a tension control system for controlling the warp yarn of the woven fabric with the warp yarn tension as a control target. As disclosed in U.S. Pat. No. 3,802,467 (DE-AS No. 2 206 781), U.S. Pat. No. 4,031,923 (DE-AS No. 2 555 986), and U.S. Pat. No. 4,407,331 (DE-AS No. 2 939 607), for example, a typical tension control system is composed of a main loop or a tension control system for effecting PI (proportional-plus-integral) control and a minor loop or a speed control system having an increased response speed.

The tension of a warp yarn pulsates during one revolution in response to principal movement of the loom. The pulsating tension variation is normally not controlled by the tension control system. The general tension control system of the type described has an integrating circuit having a large time constant as disclosed in the foregoing prior patents. Any tension variations in one revolution of the loom are absorbed by an integrating function of the integrating circuit. Because of the presence of the integrating function, however, the detection by the tension control system of any tension variations is slow, and the loom is subjected to a large operational variation when it is started again.

The loom generally has a weft stop motion for automatically stopping the loom at the time of a weft insertion failure. When the loom is stopped, the weft yarn is restored. If the operation of the loom is interrupted, then the fabric being woven will have a stop mark corresponding to the position of the interruption, the stop mark being a product flaw. The stop mark is produced since (1) the fell is retracted by extracting the defective weft yarn upon a weft insertion failure, (2) the yarns are elongated and the fabric shrinks while the loom stops for a long time, and (3) the inserted weft yarn is beaten up under an insufficient force at the time the loom is started.

While the loom is in a transient operation, therefore, the tension control system is incapable of ideal control of warp tension due to the integrating function thereof with the large time constant. To prevent stop marks from being produced, control would be effected for optimizing the rate of letting off the warp yarn when the loom is in a transient mode such as inching operation, reverse operation, and starting operation. However, such a control mode would retard the response of the tension control system, failing to achieve reliable control. Accordingly, the conventional tension control system is incapable of optimum control especially in a transient loom operation such as an initial starting operation or a restarting operation, and cannot avoid stop marks produced in woven fabrics.

SUMMARY OF THE INVENTION

It is an object of the present invention to enable a tension control system to achieve optimum control, especially in a transient loom operation, which has been impossible to achieve, for preventing stop marks from being produced in woven fabrics.

According to the present invention, a motor-driven let-off or take-up motion in a loom is controlled by a tension control system or a tension feedback control system and additionally by a feedforward control system which performs a corrective action based on operation data such as operation modes and weaving condition of the loom during a transient operation such as an inching operation, a reverse operation, or a starting operation of the loom, which cannot sufficiently be controlled by the tension feedback control system. Details of such feedforward control are stored as operation patterns for respective operation modes and weaving conditions of the loom. The feedforward control process comprises the steps of detecting a present operating condition of the loom, reading an optimum operation pattern from the stored patterns, generating a control signal based on the read operation pattern, and applying the control signal to a motor which drives the let-off or take-up motion rather than through the tension control system, in coaction with the rotation of the loom, Therefore, the motor for the let-off or take-up motion is normally under the control of the tension control system or a main loop. In a transient operating condition, the motor is controlled by the control system of the feedforward control system based on the operating pattern determined according to the operating condition and the weaving condition of the loom so that the loom can be subjected to rotation optimum for the transient operating condition.

The foregoing feedforward control is a considerably sophisticated control technique and has to be achieved at an increased response speed per revolution of the loom. Consequently, such feedforward control cannot be realized at an ideal response speed with an ordinary control technique such as a relay control sequence.

Accordingly, it is another object of the present invention to achieve the feedforward control at a high speed with computer technology.

The above object can be achieved by employing a central processing unit as a major control component and a memory and input and output units combined with the central processing unit in assembling a feedforward control system.

With the above feedforward control, the following functions can be realized: Since the speed and direction of rotation and the angular displacement of a DC motor for driving a let-off or take-up motion are controlled as required on the basis of a pre-determined operation pattern during an operation of a loom, particularly a transient operation thereof, the movement of yarns due to rotation of a beam is reliably reflected at a fell for preventing a stop mark from being produced in a fabric being woven regardless of mechanical wear on a roll and healds.

Furthermore, inasmuch as operation patterns can be set while incorporating corrections based on predicted yarn elongation and mechanical loss of the loom, optimum control can be realized which would be impossible to achieve with the tension control system. Even if wound diameters on beams differ from loom to loom and any mechanical loss appears as a value inherent in the loom used, optimum operation patterns can be set for each loom, so that feedforward control can be accomplished which would be impossible to achieve with the tension control system.

By storing operation patterns for operation modes such as a repeated inching operation and a reverse operation, warp yarns can be advanced or moved back accurately for an interval corresponding to necessary picks.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
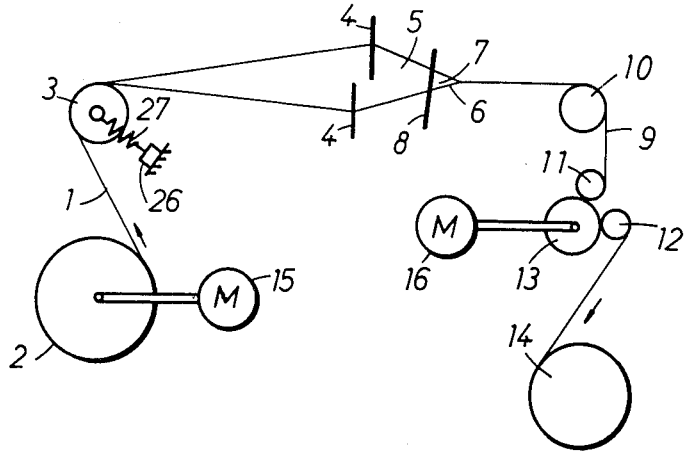
FIG. 1 is a schematic side elevational view of motor-driven let-off and take-up motions in a loom.

FIG. 1 schematically shows let-off and take-up motions in a loom. Warp yarns 1 are supplied from a supply beam 2 through a path around a tensioning roll 3 disposed above the supply beam 2 and then through a horizontal path, in which the warp yarns 1 are separated by healds 4 to form a shed 5. The warp yarns 1 are woven with a weft yarn 7 at a fell 6, the weft yarn 7 being beaten up against the fell 6 by means of a reed 8, thereby forming a woven fabric 9. The fabric 9 is directed by a fixed roll-shaped breast beam 10, guided by guide rolls 11, 12 to travel around a winding roll 13, and then successively wound by a take-up roll 14. The supply beam 2 and the winding beam 13 are driven respectively by DC motors 15, 16.

Figure 2:
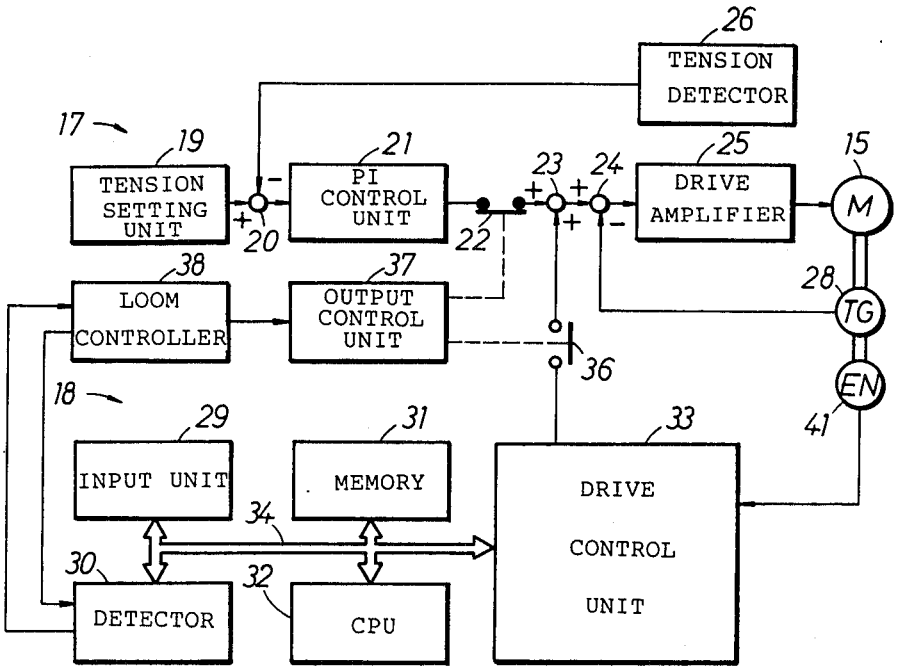
FIG. 2 is a block diagram of a control apparatus of a tension control system and a control apparatus of a feedforward control system.

FIG. 2 shows a control system for the DC motor 15 or the DC motor 16. The control system of the invention is composed of a control apparatus 17 of a tension control system and a control apparatus 18 of a feedforward control system, the control apparatus 17, 18 being selectively employed one at a time. For the sake of brevity, the DC motor 15 will be described as a control target in the following description:

The control apparatus 17 of the tension control system has a tension setting unit 19, an adding point 20, a PI (proportional-plus-integral) control unit 21, a normally closed contact 22, adding points 23, 24, and a drive amplifier 25, which are successively connected in series, the drive amplifier 25 having an output terminal connected to the DC motor 15. A tension detector 26 for detecting any tension variations of the warp yarn 1 is coupled by a spring 27 to the tensioning roll 3. The tension detector 26 is connected as a feedback element to the adding point 20 in the tension control system. The DC motor 15 is mechanically coupled to a tachogenerator 28 having an output terminal connected as a feedback loop to the adding point 24, thus constituting a speed-feedback drive control system.

The control apparatus 18 of the feedforward control system is composed mainly of an input unit 29, a detector 30, a memory 31, a central processing unit (CPU) 32, and a drive control unit 33.

The input unit 29, the detector 30, the memory 31, and the CPU 32 are interconnected by a data bus 34 and connected to an input terminal of the drive control unit 33. The drive control unit 33 has an output terminal connected via a contact 36 to the adding point 23. The contact 36 and the contact 22 are turned on or off by an output control unit 37 supplied with information necessary for control from a loom controller 38. The loom controller 38 and the detector 30 are interconnected so that there will be an exchange of information therebetween.

Figure 3:
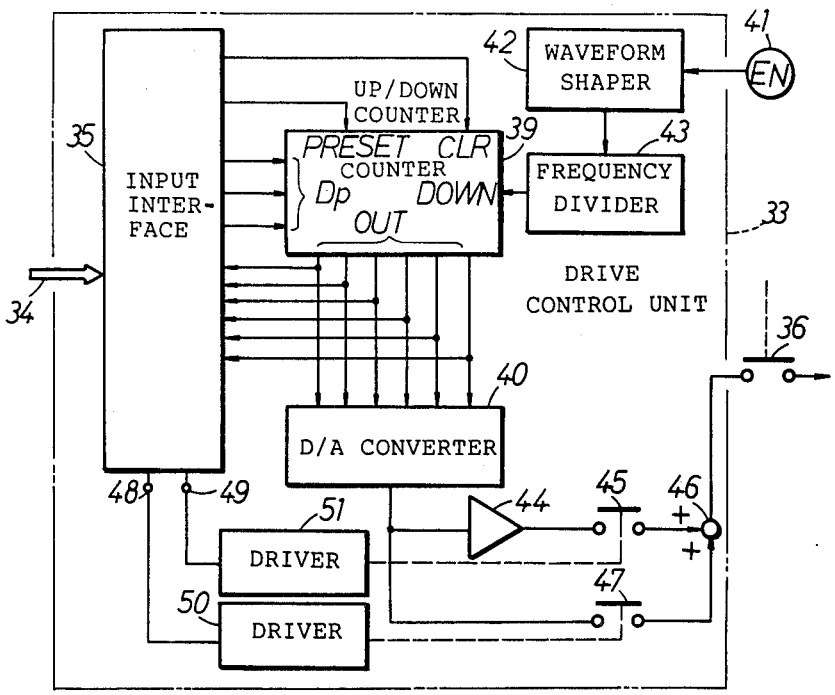
FIG. 3 is a block diagram of a drive control unit in the control apparatus of the feedforward control system.

FIG. 3 is illustrative of a specific circuit arrangement for the drive control unit 33. The drive control unit 33 includes an input interface 35 connected to Dp input terminals, a CLEAR terminal, and a PRESET terminal of an up/down counter 39 having output terminals connected to input terminals of a D/A converter 40 and the input interface 35. The tachogenerator 28 (FIG. 2) is connected to an encoder 41 connected through a waveform shaper 42 and a frequency divider 43 to a DOWN input terminal of the up/down counter 39. The D/A converter 40 has an output terminal connected through an inverting amplifier 44, a contact 45, and an adding point 46 to one side of the contact 36. The output terminal of the D/A converter 40 is branched and also coupled through a contact 47 directly to the adding point 46. The interface 35 has a normal-rotation output terminal 48 and a reverse-rotation output terminal 49 connected respectively to drivers 50, 51 which may for example be conventional electromechanical relays and which selectively operate the contacts 47, 45.

Operation of the control apparatus 17, 18 of the tension control system and the feedforward control system will be described. The control apparatus 17 of the tension control system is responsible for the control of the loom under normal operation. Tension for the, warp yarns 1 or the woven fabric 9 is given by operation of the tension setting unit !9, which may comprise a variable resistor, for example, for generating a signal indicative of a target tension which is applied through the adding point 20 to the PI control unit 21. The PI control unit 21 effects proportional control operation of integral control operation and generates a PI output signal necessary for tension control.

While the loom is in its normal operation mode, the output control unit 37 determines that the loom is in the normal operation based on information fed from the loom controller 38 and keeps the contact 22 turned on and the contact 36 turned off based on the result of determination. Therefore, the PI output signal from the PI control unit 21 is delivered through the adding points 23, 24 to the drive amplifier 25. The drive amplifier 25 is responsive to the applied PI output signal for controlling the speed of rotation or rate of rotation of the DC motor 15 as the weaving progresses. The speed of rotation of the DC motor 15 is fed as a speed feedback signal from the tachogenerator 28 back to the adding point 24. The speed feedback control system thus operates to eliminate any deviation of the actual speed of rotation of the DC motor 15 from the PI output signal from the PI control unit 21.

The actual tension of the warp yarn 1 or the fabric 9 is detected by the tension detector 26 and fed as an electric signal back to the adding point 20. The control apparatus 17 of the tension control system thus constitutes a tension feedback control system including the object to be controlled, that is, the warp yarns 1 or the fabric 9. The control apparatus 17 of the tension control system therefore serves to cause the tension of the warp yarns 1 or the fabric 9 to approach the target value as the weaving progresses and irrespectively of the progress of the weaving.

When the loom is automatically stopped due for example to a weft insertion failure, the output control unit 37 reads stop information indicative of the stop condition from the loom controller 38, turns off the contact 22 in the tension control system, and turns on the contact 36 in the feedforward control system. An output signal from the control apparatus 18 is then applied through the contact 36 to the adding point 23.

The memory 31 stores various operation data items such as directions and speeds of rotation and an angular displacement of the DC motor 15 for each operation mode of the loom. These data items are entered as operation patterns into the memory 31 by setting the CPU 32 in an input mode and operating function keys and ten-keys on a keyboard in the input unit 29. The characteristics of the operation patterns are determined in view of the operation modes of the loom such as normal operation, inching operation, reverse operation, and starting operation, the number of weft yarns to be extracted at the time of retoring them, the downtime of the loom, the wound diameters of the supply beam 2 and the take-up beam 14, and other weaving conditions. The operation pattern for starting the loom, for example, is such that before the loom is started, the warp yarns 1 are fed back for an interval corresponding to three picks, and fed along for an interval corresponding to two picks after the loom has started. Appropriate correction is effected dependent on the downtime of the loom and the wound diameters, for example, for each pick.

Figure 4:
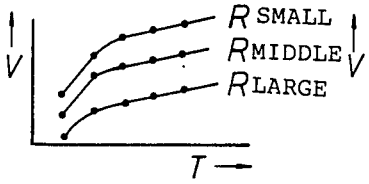
FIGS. 4 and 5 are graphs showing the relationship between a downtime and a setpoint.
Figure 5:
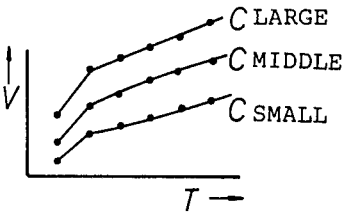

FIG. 4 shows by way of example the relationship between a downtime T and a corrective setpoint V. Correction by the wound diameter R is actually carried out by a value employed in substitution for the wound diameter R. This value can be calculated by detecting the angular displacement C of the DC motor 15 for one pick during normal operation of the loom. FIG. 5 shows examples of such an angular displacement C of the DC motor 15. The angular displacement C of rotation is also used when the DC motor 15 is rotated in a normal direction or a reverse direction at the time of inching or reversing the loom. The appropriate operation patterns are stored in the memory 31 through the above operation.

If defective weft yarns are extracted while the loom is stopped, for example, then the detector 30 detects a cause of the stoppage of the loom or a weft insertion failure and simultaneously detects the number of weft yarns extracted, and delivers the information to the CPU 32. The CPU 32 then reads the delivered information, reads the subsequent operation pattern corresponding to the information from the memory 31, temporarily stores the operation pattern as an operation program for re-starting the loom in a memory means in the CPU 32, and sends the program through the interface 35 to the drive control unit 33. The CPU 32 first feeds a signal through the interface 35 to the CLEAR terminal of the counter 39 to set the counter 39 to "0", and then applies a load signal to the PRESET terminal of the counter 39 to deliver a setpoint V required for reversing the loom for three picks, for example, to the counter 39. The CPU 32 also delivers a reversing output through the interface 35 to the driver 51 to keep the contact 45 turned on. After the above preparatory operation, the drive control unit 33 rotates the DC motor 15 in a reverse direction prior to the starting of the loom. When the DC motor 15 is reversed, the angular displacement of such reverse rotation is electrically detected by the encoder 41. The output signal from the encoder 41 is shaped by the waveform shaper 42 into a rectangular waveform which is frequency-divided by the frequency divider 43, the output of which is fed to the DOWN terminal of the counter 39. The present count of the counter 39 is converted by the D/A converter 40 from a digital signal into an analog signal which is applied through the inverting amplifier 44 to the adding point 46. The count or output signal from the counter 39 is also fed through the interface 35 to the CPU 32. When the count reaches "0", that is, when the DC motor 15 is reversed for an interval corresponding to three picks, the CPU 32 detects the count "0", turns off the contact 45, and turns on the contact 47. Thereafter, the CPU 32 feeds a setpoint corresponding to two picks for rotating the DC motor 15 in a normal direction through the interface 35 to the counter 39. By thus rotating the DC motor in the reverse direction for a one-pick interval as a net result, the warp yarns 1 are given appropriate tension. With the warp yarns 1 thus pulled back, the fell 6 is retracted accurately for an interval corresponding to the extracted defective weft yarns and moved backward slightly of the normal position of the fell 6.

Appropriate preparatory action is effected in the manner described above for moving back the fell for an interval corresponding to one pick before the loom is actually started.

Subsequently, the loom is started for commencing a normal mode of weaving operation.

The force with which the reed 8 beats the weft yarn 7 against the fell 6 until the loom reaches a normal speed of rotation is smaller than that while the loom is operating at the normal speed of rotation. Since however the DC motor 15 has been reversed to retract the fell 6, the reed 8 beats the weft yarn 7 against the retracted fell 6 under a prescribed force to weave the weft yarn 7 with the warp yarns 1 even if the reed 8 itself has a weak beating force. Variations in the rotational speeds of the DC motors 15, 16 during this period are set with a view to increasing the beating force up to a prescribed value during an initial starting or transient operating condition of the loom.

Thereafter, the DC motor 15 is rotated in a normal direction for an interval which is one pick greater to advance the fell 6 for one pick. The advancing of the fell 6 is effective in preventing the fabric 9 from having a heavy filling bar at the time the beating force is stabilized. After the rotation in the normal rotation has been completed, the function of the control apparatus 18 of the feedforward control system in a transient operation of the loom is finished. Therefore, the control apparatus 18 of the feedforward control system detects that the loom enters the normal rotational condition based on the information from the loom controller 38 and turns off the contact 47.

At this time, the output control unit 37 turns off the contact 36 and turns on the contact 22. Consequently, only the control apparatus 17 is capable of controlling the DC motor 15. The foregoing fell position control is given by way of example only and the present invention is not limited to the illustrated arrangement. Various patterns may be set dependent on the fabrics to be woven on the loom. Although the contacts 22, 36, 45, 47 are shown as contact switches, they may be constructed as contactless switches such as semiconductor switches.

Figure 6:
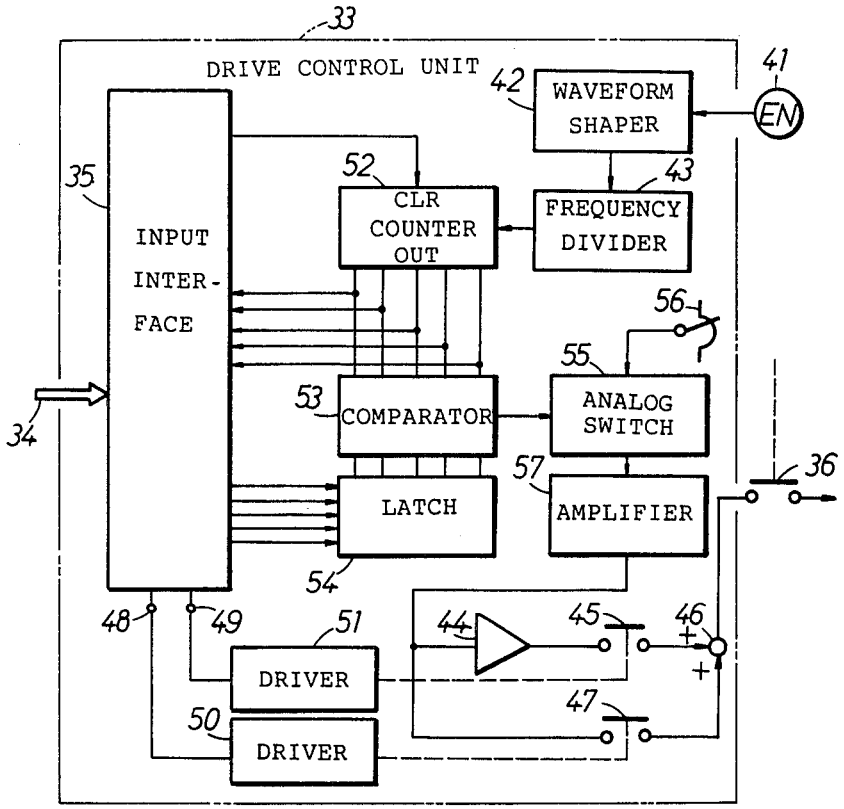
FIG. 6 is a block diagram of a drive control unit according to another embodiment of the present invention.

FIG. 6 illustrates a drive control unit 33 according to another embodiment of the present invention. In FIG. 6, the drive control unit 33 includes an ordinary counter 52, a comparator 53, and a latch 54. The counter 52 is cleared by a clear signal from the interface 35 and issues an output signal to the comparator 53 and also as a count through the interface 35 to the CPU 32. A setpoint given through the CPU 32 is read into the latch 54 when a load signal is recieved. The comparator 53 compares the count of the counter 52 and the setpoint from the latch 54, and turns on or off an analog switch 55 dependent on the result of such comparison. The analog switch 55 has an input terminal connected to a variable resistor 56 through which a suitable speed command signal setting is applied to the analog switch 55. The analog switch 55 is operated by an output signal from the comparator 53 to apply the speed command signal setting to an amplifier 57 which produces a speed command signal. The amplifier 57 has an output terminal connected via the inverting amplifier 44 to the contact 45 and also to the contact 47.

While in the above embodiment the DC motor 15 has been described as the control target, the DC motor 16 can also be controlled by the control apparatus 18 of the feedforward control system. The control of the DC motor 16 can be realized by replacing the DC motor 15 with the DC motor 16 in FIG. 2.

Although certain preferred embodiments have been shown and described, it should be understood that many changes and modifications may be made therein without departing from the scope of the appended claims.

What is claimed is:

1. A method of controlling motor-driven let-off and take-up motions in a loom, comprising the steps of:

(a) controlling the rotation of a motor for driving an object with a tension control system operating in response to a signal indicative of a target tension and a feedback input signal indicative of an actual tension of the object during a normal operation of the loom;

(b) controlling the rotation of the motor with a feedforward control system during a transient operation of the loom, said feedforward control system storing operation patterns of directions and speeds of rotation and an angular displacement of the motor for respective operation modes and weaving condition of the loom;

(c) detecting an operation mode of the loom at the time of the transient operation;

(d) reading an appropriate operation pattern from the feedforward control system based on the detected operation mode; and (e) applying the read operation pattern as a control signal to a drive control system for the motor.

2. An apparatus for controlling let-off and take-up motions in a loom, comprising:

(a) a first control apparatus of a tension control system for controlling an object; and (b) a second control apparatus of a feedforward control system for controlling the object, (c) said first control apparatus including:

(1) a tension setting unit for generating a signal indicative of a target tension for the object;

(2) a tension detector for detecting an actual tension of the object and generating a feedback signal;

(3) a PI control unit for effecting PI operation on the target tension signal and the feedback signal; and (4) a drive amplifier for controlling a motor for driving the object based on a PI output signal from said PI control unit, and (d) said second control apparatus including:

(1) an input unit for entering operation data items of directions and speeds of rotation and an angular displacement of the motor for respective operation modes and weaving conditions of the loom;

(2) a memory for storing the operation data items from said input unit as a plurality of operation patterns;

(3) a detector for detecting an operating condition of the loom upon a transient operation of the loom;

(4) a central processing unit for reading an appropriate operation pattern dependent on the detected operating condition from said memory and generating a control signal; and (5) a drive control unit responsive to the control signal from said central processing unit for driving the motor based on a given speed pattern.

3. An apparatus according to claim 2, wherein said first control apparatus and said second control apparatus are connected through respective contacts to an input terminal of said drive amplifier, wherein the loom control apparatus further includes a loom controller and an output control unit connected thereto, and wherein said output control unit includes means for closing a selected one of said contacts based on information on the operational conditions of the loom supplied from said loom controller.

4. An apparatus according to claim 2, wherein said drive control unit is connected to said central processing unit through a data bus and an interface, includes a down counter for accepting a setpoint supplied from said central processing unit through said interface and representative of an angular displacement of the motor and for counting down in response to a signal supplied from an encoder coupled to the motor and indicative of an actual angular displacement of the motor, a D/A converter for converting the value in the counter into an analog signal, and driver means controlled by said central processing unit through said interface for converting said analog signal from said D/A converter into a normal or a reverse rotation signal and for selectively issuing the normal or reverse rotation signal as a control signal for the motor.

5. An apparatus according to claim 2, wherein said drive control unit is connected to said central processing unit through a data bus and an interface, and includes a latch for storing a setpoint supplied by said central processing unit through said interface and representative of an angular displacement of the motor, a counter for counting a signal supplied from an encoder coupled to the motor and indicative of an actual angular displacement of the motor, a comparator for comparing a value in said counter and the setpoint in said latch and for generating a signal dependent on the result of the comparison, analog switch means for turning on and turning off a speed command signal supplied by a variable resistor in response to said signal from said comparator, and driver means controlled by said central processing unit through said interface for issuing the speed command signal from said analog switch means as a selected one of a normal and a reverse rotation signal which respectively effect normal and reverse rotation of the motor.

* * * * *